US011139601B2

(12) United States Patent
Meng et al.

(10) Patent No.: US 11,139,601 B2
(45) Date of Patent: Oct. 5, 2021

(54) BOARD-TO-BOARD CONNECTOR

(71) Applicant: ADVANCED-CONNECTEK INC., New Taipei (TW)

(72) Inventors: Ta-Teh Meng, New Taipei (TW); Mei Shi, New Taipei (TW); Ya-Ping Liang, New Taipei (TW); Ping Shi, New Taipei (TW); Meng Liu, New Taipei (TW); Jing-Zhe Wang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 16/884,519

(22) Filed: May 27, 2020

(65) Prior Publication Data

US 2020/0381857 A1 Dec. 3, 2020

(30) Foreign Application Priority Data

May 29, 2019 (CN) ..... 201920790484.2

(51) Int. Cl.

| | |
|---|---|
| ***H01R 13/20*** | (2006.01) |
| ***H01R 13/115*** | (2006.01) |
| ***H01R 13/631*** | (2006.01) |
| ***H01R 13/04*** | (2006.01) |
| ***H01R 13/50*** | (2006.01) |
| *H01R 12/71* | (2011.01) |

(52) U.S. Cl.

CPC ..... *H01R 13/20* (2013.01); *H01R 13/04* (2013.01); *H01R 13/115* (2013.01); *H01R 13/50* (2013.01); *H01R 13/631* (2013.01); *H01R 12/716* (2013.01)

(58) Field of Classification Search

CPC ..... H01R 13/20; H01R 13/04; H01R 13/115; H01R 13/50; H01R 13/631; H01R 12/716

See application file for complete search history.

(56) References Cited

U.S. PATENT DOCUMENTS

| | | | | |
|---|---|---|---|---|
| 8,845,339 | B2 * | 9/2014 | Ono | H01R 12/712 439/74 |
| 9,899,771 | B2 * | 2/2018 | Ashibu | H01R 12/716 |
| 10,249,969 | B2 * | 4/2019 | Ono | H01R 13/504 |
| 10,651,581 | B1 * | 5/2020 | Sasayama | H01R 4/02 |
| 10,868,378 | B2 * | 12/2020 | Ko | H01R 12/716 |
| 10,931,044 | B2 * | 2/2021 | Meng | H01R 12/716 |
| 2014/0227910 | A1 * | 8/2014 | Tanaka | H01R 13/6275 439/626 |
| 2015/0214643 | A1 * | 7/2015 | Lee | H01R 12/7029 439/655 |

(Continued)

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

A first connector and a second connector are provided. The first connector includes an insulated body, first terminals, and fastening members. The first terminals and the fastening members are on the insulated body. The second connector includes an insulated base, second terminals, and positioning members. The second terminals and the positioning members are on the insulated base. The fastening members and the positioning members are enclosing structures covering the insulated body of the first connector and the insulated base of the second connector, respectively. The fastening members and the positioning members provide multi-point contacts.

11 Claims, 15 Drawing Sheets

(56) References Cited

U.S. PATENT DOCUMENTS

| | | | | |
|---|---|---|---|---|
| 2015/0263464 | A1* | 9/2015 | Arichika | H01R 13/6275<br>439/374 |
| 2016/0315430 | A1* | 10/2016 | Takeuchi | H01R 12/00 |
| 2017/0093061 | A1* | 3/2017 | Lee | H01R 12/73 |
| 2019/0131731 | A1* | 5/2019 | Lee | H01R 13/405 |
| 2019/0363467 | A1* | 11/2019 | Ko | H01R 13/627 |
| 2019/0372250 | A1* | 12/2019 | Takeuchi | H01R 13/6275 |
| 2020/0136284 | A1* | 4/2020 | Meng | H01R 12/716 |
| 2020/0381856 | A1* | 12/2020 | Meng | H01R 13/6594 |
| 2020/0395704 | A1* | 12/2020 | Hosoda | H01R 12/716 |
| 2020/0403336 | A1* | 12/2020 | Xie | H01R 12/57 |

* cited by examiner

BOARD-TO-BOARD CONNECTOR

CROSS-REFERENCE TO RELATED APPLICATION

This non-provisional application claims priority under 35 U.S.C. § 119(a) to Patent Application No. 201920790484.2 filed in China, P.R.C. on May 29, 2019, the entire contents of which are hereby incorporated by reference.

FIELD OF THE INVENTION

The instant disclosure relates to an electrical connector, and more particular to a board-to-board connector.

BACKGROUND

Consumer electronics tend to become smaller, thinner, and lighter. Hence, electrical connections are usually established between different circuit boards in the consumer electronics. For such electronic device, as the size of the electronic device is small, the electronic device has a relatively limited internal space. Therefore, the circuit boards are electrically connected with each other through board-to-board (BTB) electrical connector(s), so that the electronic device can have better space utilization.

SUMMARY OF THE INVENTION

The BTB electrical connector is an electrical connector assembly. The electrical connector assembly comprises a first connector and a second connector corresponding to the first connector. The first connector is arranged with a plurality of first terminals. The second connector is arranged with a plurality of second terminals. When the first connector is inserted into the second connector, the first terminals are mated with the second terminals to achieve the signal transmission between two printed circuit boards.

An embodiment of the instant disclosure provides a first connector. The first connector comprises an insulated body, a plurality of first terminals, and a plurality of fastening members. The insulated body comprises a pair of first side walls and a pair of first end walls. The pair of first side walls and the pair of first end walls are enclosed to form a first connection space. The first terminals are held in the pair of first side walls. Each of the fastening members comprises a first covering plate and a plurality of first side plates. Each of the first covering plates is held in an outer surface of each of the first end walls. An end top plate extends from each of the first covering plates and covers a top portion of each of the first end walls. An end contact sheet is in the first connection space and bends inwardly from the end top plate, and the end contact sheet covers an inner surface of each of the first end walls. Each of the first side plates is held in an outer surface of each of the first side walls. A side top plate extends from each of the first side plates and covers a top portion of each of the first side walls. A side contact sheet is in the first connection space and bends inwardly from the side top plate, and the side contact sheet covers an inner surface of each of the first side walls.

In some embodiments, each of the fastening members comprises a plurality of turning sheets extending from two ends of each of the first covering plates toward each of the first side plates.

In some embodiments, a notch is formed between each of the first side plates and the two ends of each of the first covering plates.

In some embodiments, a plurality of concave portions is recessed from a bottom end of each of the first covering plates.

In some embodiments, one or more legs are on each of the first side plates.

Another embodiment of the instant disclosure provides a second connector for mating with the foregoing first connector. The second connector comprises an insulated base, a plurality of second terminals, and a plurality of positioning members. The insulated base comprises a pair of second side walls and a pair of second end walls. The pair of second side walls and the pair of second end walls are enclosed to form a second connection space. The insulated base comprises a guiding column in an inner portion of the second connection space. The second terminals are respectively held in the pair of second side walls and two sides of the guiding column. Each of the positioning members comprises a second covering plate, a plurality of second side plates, and a plurality of contact arms. Each of the second covering plates is held in an outer surface of each of the second end walls. An end top plate extends from each of the second covering plates and covers a top portion of each of the second end walls. An end contact sheet is in the second connection space and bends inwardly from the end top plate and covers an inner surface of each of the second end walls. Each of the second side plates is held in an outer surface of each of the second side walls. A side top plate extends from each of the second side plates and covers a top portion of each of the second side walls. A side contact sheet is in the second connection space and bends inwardly from the side top plate, and the side contact sheet covers an inner surface of each of the second side walls. The contact arms are respectively held in the inner portion of the second connection space and the two sides of the guiding column.

In some embodiments, each of the contact arms comprises an extension arm and an elastic arm. The extension arm extends outwardly from a bottom portion of the side contact sheet of each of the second side plates to the inner portion of the second connection space. The elastic arm bends outwardly from an end portion of the extension arm toward a side portion of the guiding column.

In some embodiments, a protruding portion protrudes from the side contact sheet of each of the second side plates.

In some embodiments, each of the contact arms comprises a first extension portion, a second extension portion, a third extension portion, and two fourth extension portions. The first extension portion bends outwardly from a bottom portion of the end contact sheet of each of the second covering plates toward the inner portion of the second connection space. The second extension portion bends outwardly from an end portion of the first extension portion toward an end portion of the guiding column. The third extension portion bends outwardly from a top portion of the second extension portion toward a top portion of the guiding column. The two fourth extension portions bend outwardly from two sides of the third extension portion toward the side portion of the guiding column.

In some embodiments, each of the contact arms comprises two extension arms and two elastic arms. Each of the extension arms bends outwardly from an end portion of each of the fourth extension portions toward the inner portion of the second connection space. Each of the elastic arms bends outwardly from an end portion of each of the extension arms toward the inner surface of each of the second side walls.

According to one or some embodiments of the instant disclosure, the fastening member is an enclosing structure. The first covering plates and the first side plates respectively cover the pair of first side walls and the pair of first end walls of the insulated body, so that the first covering plates, the end contact sheets, the first side plates, and the side contact sheets provide multi-point contacts.

According to one or some embodiments of the instant disclosure, the positioning member is a large-area enclosing structure. The second covering plates and the second side plates respectively cover the pair of second side walls and the pair of second end walls of the insulated base, so that the end contact sheets, the side contact sheets, and the contact arms provide multi-point contacts.

According to one or some embodiments of the instant disclosure, the contact areas of the concave portions of the first covering plates of the second connector increase. Hence, when the first connector is welded on the circuit board, the proper fixation for solder contact as well as multi-point welding design can be provided.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
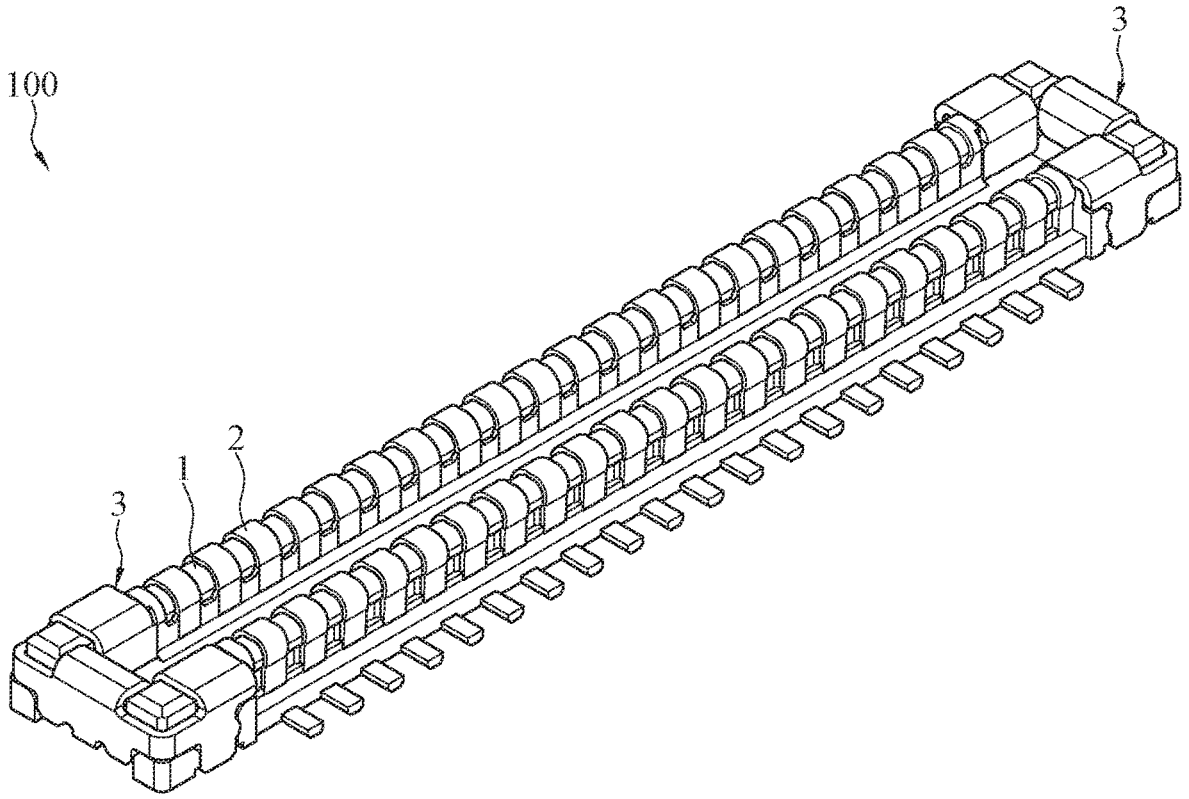
FIG. 1 illustrates a perspective view of a first connector according to a first embodiment of the instant disclosure.
Figure 2:
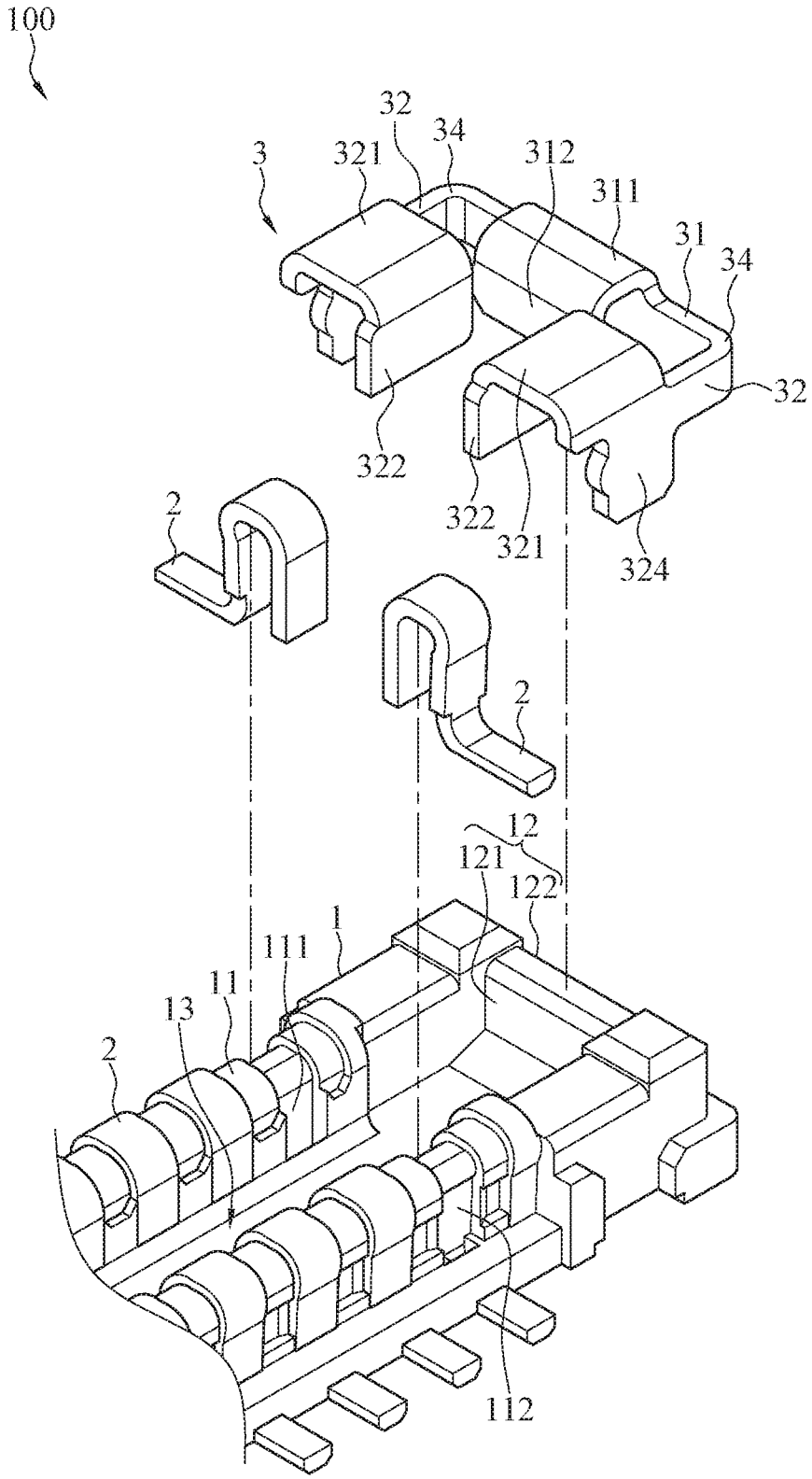
FIG. 2 illustrates an exploded view of the first connector of the first embodiment.
Figure 3:
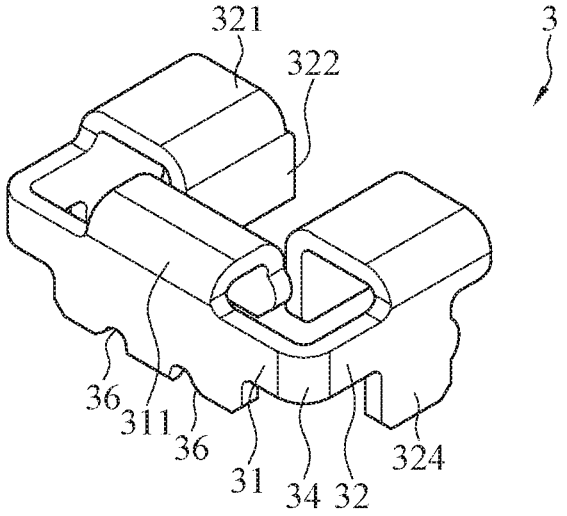
FIG. 3 illustrates a perspective view of a fastening member of the first connector of the first embodiment.

Please refer to FIGS. 1 to 3, a first connector 100 according to a first embodiment of the instant disclosure is illustrated. FIG. 1 illustrates a perspective view thereof, FIG. 2 illustrates an exploded view thereof, and FIG. 3 illustrates a perspective view of a fastening member thereof. In this embodiment, the first connector 100 comprises an insulated body 1, a plurality of first terminals 2, and a plurality of fastening members 3 (hold down).

In this embodiment, the insulated body 1 is an elongated plastic body. The insulated body 1 comprises a bottom wall, a pair of first side walls 11, and a pair of first end walls 12. The pair of first side walls 11 is opposite to and parallel to each other. The pair of first end walls 12 is opposite to and parallel to each other. In particular, in one embodiment, the pair of first side walls 11 is arranged on the bottom wall in a longitudinal direction X, the pair of first end walls 12 is arranged on the bottom wall in a transverse direction Y, and the pair of first side walls 11 and the pair of first end walls 12 are enclosed to form a first connection space 13.

In this embodiment, the first terminals 2 are arranged on the insulated body 1 and arranged in two opposite rows. Each of the first terminals 2 comprises a first contact portion, a second contact portion, and a first tail portion integrally formed with each other, and the first tail portion extends out of the insulated body 1. The first contact portion and the second contact portion are bent, folded, and arranged side by side. The first contact portion is in the first connection space 13 and abutted against one of two surfaces of the first side wall 11. The second contact portion is at the other surface of the first side wall 11. The first terminals 2 are used for signal transmission, and the transmission current is from 0.3 to 0.5 A.

In this embodiment, from a top view, each of the fastening members 3 is approximately formed as an upside-down U-shaped plate. Each of the fastening members 3 comprises a first covering plate 31 and a plurality of first side plates 32 integrally formed with each other.

In this embodiment, each of the first covering plates 31 is held in an outer surface 122 of each of the first end walls 12. An end top plate 311 extends from each of the first covering plates 31 and covers a top portion of each of the first end walls 12. An end contact sheet 312 is in the first connection space 13 and bends inwardly from the end top plate 311, and the end contact sheet 312 covers an inner surface 121 of each of the first end walls 12.

In this embodiment, each of the first side plates 32 is held in an outer surface 112 of each of the first side walls 11. A side top plate 321 extends from each of the first side plates 32 and covers a top portion of each of the first side walls 11, and a side contact sheet 322 is in the first connection space 13 and bends inwardly from the side top plate 321, and the side contact sheet 322 covers an inner surface 111 of each of the first side walls 11.

In this embodiment, the fastening member 3 is an enclosing structure. Moreover, the first covering plates 31 and the first side plates 32 cover the pair of first side walls 11 and the pair of first end walls 12 of the insulated body 1, so that the first covering plates 31, the end contact sheets 312, the first side plates 32, and the side contact sheets 322 provide multi-point contacts. Accordingly, as the connector has two or more contact points, the stability of current output can be ensured, the requirements for large-current transmission can be achieved, and the heat generated by the elements can be reduced. The connector is applicable for quick charging purposes. Furthermore, some contact points in the multi-point contacts can be used as spare contacts.

In this embodiment, more particularly, each of the fastening members 3 comprises a plurality of turning sheets 34 extending from two ends of each of the first covering plates 31 toward each of the first side plates 32, but embodiments are not limited thereto. Accordingly, the turning sheets 34 are covered at corners of the insulated body 1 to increase the coverage area, thereby enhancing the coverage effect and the structural strength of the product.

In this embodiment, more particularly, the material of the fastening member 3 may be replaced according to different requirements, for example, a material specified in large-current (3 A to 5 A or 3 A to 10 A) or signal source transmission can be chosen as the material of the fastening member 3.

In this embodiment, more particularly, a plurality of concave portions 36 is recessed from a bottom end of each of the first covering plates 31. Accordingly, the contact areas of the concave portions 36 of the first covering plates 31 increase. Hence, when the first connector 100 is welded on the circuit board, the proper fixation for solder contact as well as multi-point welding design can be provided. The concave portions 36 can store excess solder to avoid solder crawling, thereby effectively avoiding product failure. The multi-point welding design ensures that the connector product is not easy to detach from the board and avoids open circuit of components.

In this embodiment, more particularly, a leg 324 is on each of the first side plates 32.

Figure 4:
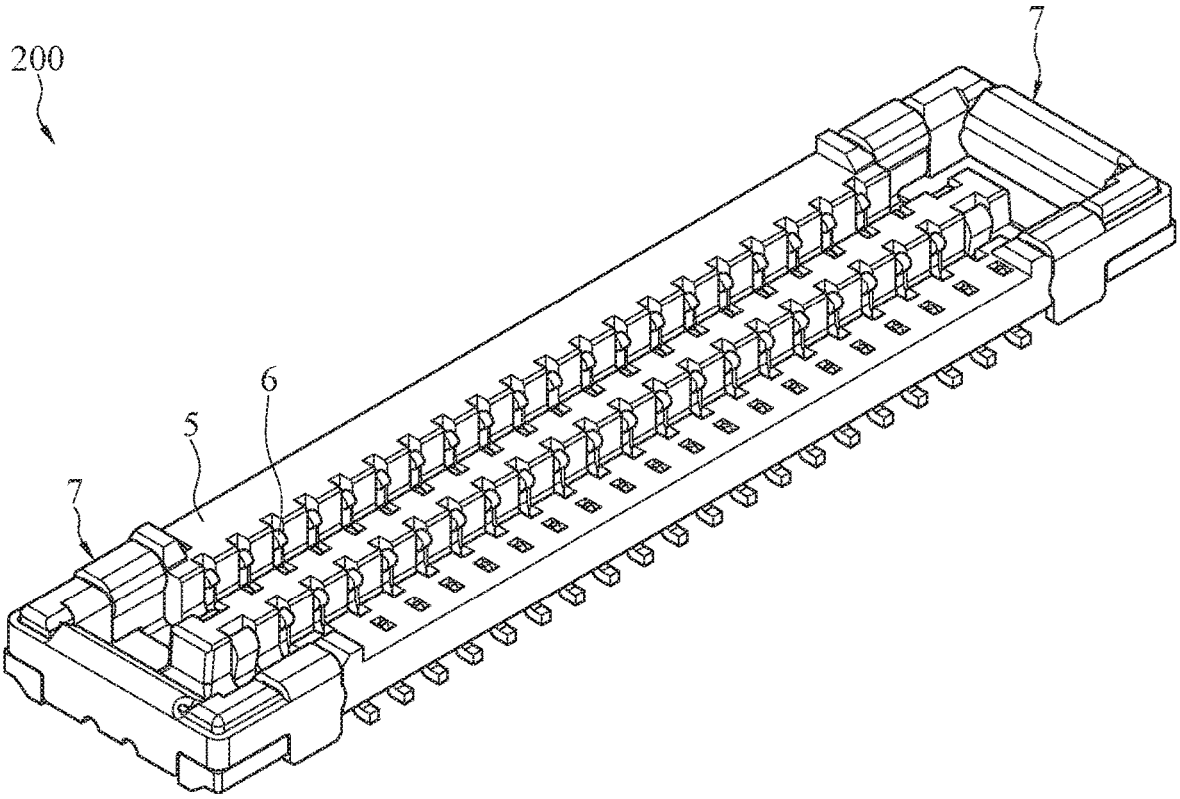
FIG. 4 illustrates a perspective view of a second connector of the first embodiment.
Figure 5:
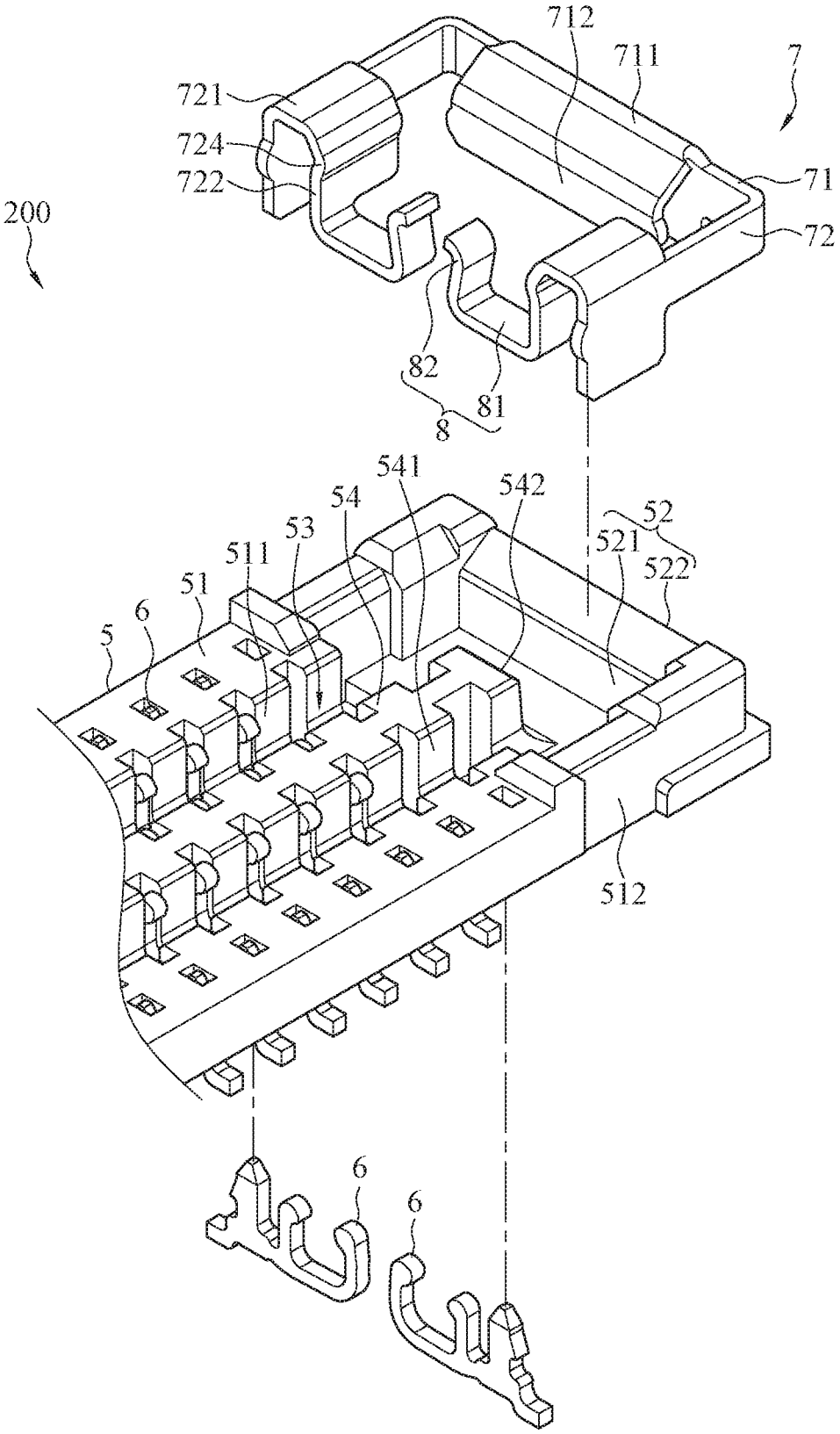
FIG. 5 illustrates an exploded view of the second connector of the first embodiment.
Figure 6:
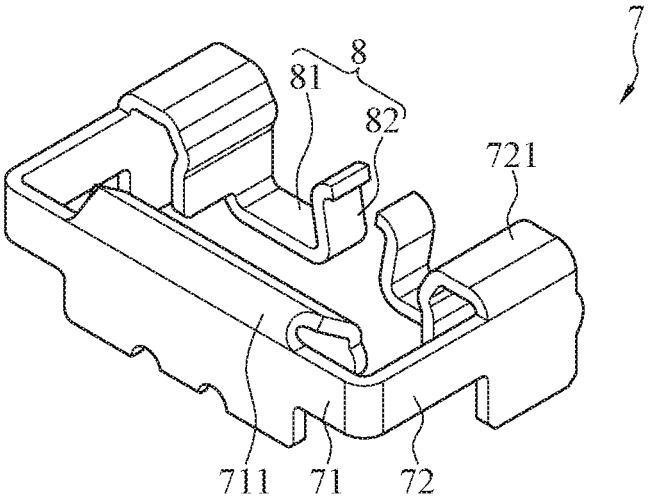
FIG. 6 illustrates a perspective view of a positioning member of the second connector of the first embodiment.

Please refer to FIGS. 4 to 6, a second connector 200 of the first embodiment is illustrated. FIG. 4 illustrates a perspective view thereof, FIG. 5 illustrates an exploded view thereof, and FIG. 6 illustrates a perspective view of a positioning member 7 thereof. In this embodiment, the second connector 200 comprises an insulated base 5, a plurality of second terminals 6, and a plurality of positioning members 7.

Figure 8:
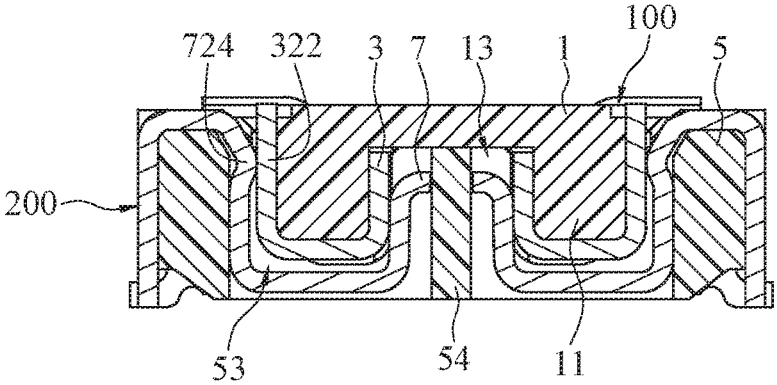
FIG. 8 illustrates a cross-sectional view along line 4-4 shown in FIG. 7.

In this embodiment, the insulated base 5 is an elongated plastic body. The insulated base 5 comprises a bottom wall, a pair of second side walls 51, and a pair of second end walls 52. The pair of second side walls 51 is arranged on the bottom wall along a longitudinal direction X, the pair of second end walls 52 is arranged on the bottom wall along a transverse direction Y, and the pair of second side walls 51 and the pair of second end walls 52 form a second connection space 53. When the first connector 100 is inserted into the second connector 200 (as shown in FIG. 8), the pair of first side walls 11 is inserted into the second connection space 53.

In this embodiment, the insulated base 5 comprises a guiding column 54 in the second connection space 53, that is, in this embodiment, the bottom wall of the second connector 200 comprises a guiding column 54 protruding toward the interior of the second connection space 53. A plurality of terminal slots is respectively arranged on the inner side surfaces 511 of the pair of second side walls 51 and both sides of the corresponding guiding column 54, and the terminal slots are arranged along the longitudinal direction X. The terminal slots are defined through the bottom wall and communicate with the second connection space 53.

In this embodiment, the second terminals 6 are arranged on the insulated base 5 and arranged in two opposite rows. Each of the second terminals 6 comprises an arm portion, a pair of elastic clamping arms, a fixed arm, and a second tail portion which is passing through the bottom of the insulated base 5. Moreover, each of the second terminals 6 is a blanking-type terminal.

In this embodiment, the arm portion is laterally arranged under the bottom wall, while the pair of elastic clamping arms extends outwardly from one side surface of the arm portion toward the terminal slots. The elastic clamping arms is a flexible clamping structure. When the first connector 100 is inserted into the second connector 200, the elastic clamping arm swings with the fixed arm as the fulcrum.

In this embodiment, the elastic clamping arm has an arc protrusion relatively protruding outwardly. The two arc protrusions are in the second connection space 53, and the arc protrusions correspond to the turning sections of the second terminals 6 so as to guide the first connector 100 to be smoothly inserted into the second connector 200. Moreover, the pair of elastic clamping arms and the arm portion are formed as a U-shaped structure. With the two arc protrusions, the second terminal 6 provides two-point contacts and a clamping structure with two flexible arms, thereby having good anti vibration and anti-loosening effects.

In this embodiment, the fixed arm extends outwardly from the other side of the arm portion. The fixed arm, the pair of elastic clamping arms, and the arm portion are together formed as a laid-down E-shaped structure.

In this embodiment, each of the positioning members 7 comprises a second covering plate 71, a plurality of second side plates 72, and a plurality of contact arms 8.

In this embodiment, each of the second covering plates 71 is held in the outer surface 522 of each of the second end walls 52. An end top plate 711 extends from each of the second covering plates 71 and covers a top portion of each of the second end wall 52. An end contact sheet 712 is in the second connection space 53 and bends inwardly from the end top plate 711, and the end contact sheet 712 covers an inner surface 521 of each of the second end walls 52.

In this embodiment, each of the second side plates 72 is held in an outer surface 512 of each of the second side walls 51. A side top plate 721 extends from each of the second side plates 72 and covers a top portion of each of the second side walls 51. A side contact sheet 722 is in the second connection space 53 and bends inwardly from the side top plate 721 and covers an inner surface 511 of each of the second side walls 51.

In this embodiment, the contact arms 8 are respectively held in the inner portion of second connection space 53 and the two sides of the guiding column 54.

In this embodiment, the positioning member 7 is a large-area enclosing structure. Moreover, the second covering plates 71 and the second side plates 72 cover the pair of second side walls 51 and the pair of second end walls 52 of the insulated base 5, so that the end contact sheet 712, the side contact sheet 722, and the elastic arm 82 of the contact arms 8 provide multi-point contacts.

In this embodiment, more specifically, each of the contact arms 8 comprises an extension arm 81 and an elastic arm 82. The extension arm 81 extends outwardly from a bottom portion of the side contact sheet 722 of each of the second side plates 72 toward the inner portion of the second connection space 53. The elastic arm 82 bends outwardly from an end portion of the extension arm 81 toward a side portion 541 of the guiding column 54. In this embodiment, each of the contact arms 8 is integrated with each of the positioning members 7. Each of the contact arms 8 extends inwardly from the side contact sheet 722 of each of the second side plates 72. From a side view, each of the contact arms 8 has a L-shaped appearance.

In this embodiment, more specifically, from a side view, each of the side contact sheets 722 and each of the contact arms 8 are together formed as a U-shaped structure. Each of the contact arms 8 extends to form a contact force arm with a longer distance, providing better elastic recovery effect, thereby reducing the risk of elastic fatigue.

In this embodiment, more specifically, a protruding portion 724 protrudes from each of the side contact sheets 722 of the second side plates 72, so that the protruding portion can be in interfering contact with the first side plate 32 of the first connector 100. Hence, the protruding portion 724 is provided as an outer buckle structure. Conversely, the elastic arm 82 of each of the contact arms 8 is in interfering contact with the side contact plate 322 of the first connector 100 (as shown in FIG. 8). Hence, the contact arm 8 is provided as an inner buckle structure. The inner and outer buckle structures ensure that the first connector 100 and the second connector 200 are mated with each other properly to prevent the first connector 100 from falling off the second connector 200.

Figure 7:
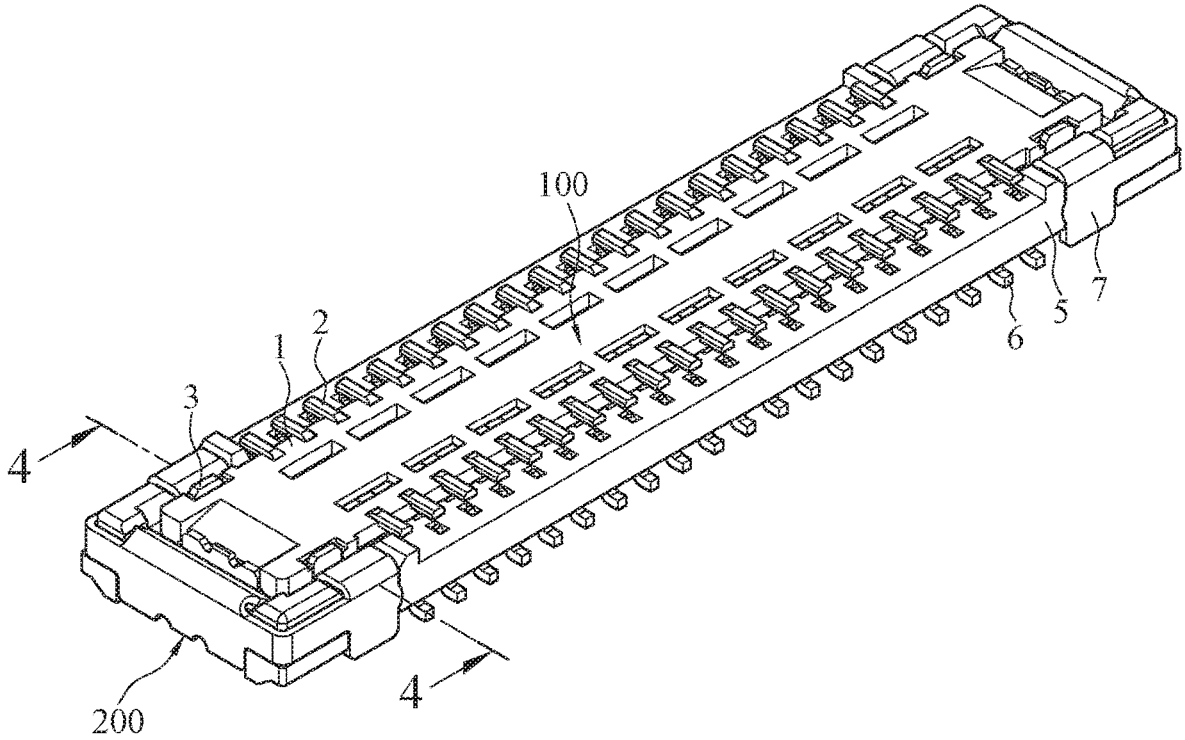
FIG. 7 illustrates a perspective view showing that the first connector is mated with the second connector of the first embodiment.

Please refer to FIGS. 7 and 8, an electrical connector assembly of the first embodiment of the instant disclosure is illustrated. FIG. 7 illustrates a perspective view showing that the first connector is mated with the second connector. FIG. 8 illustrates a cross-sectional view along line 4-4 shown in FIG. 7. In the first embodiment, the electrical connector assembly comprises an first connector 100 and an second connector 200 capable of being mated with each other, and the electrical connector assembly belongs to the board to board (BTB) electrical connector.

Figure 9:
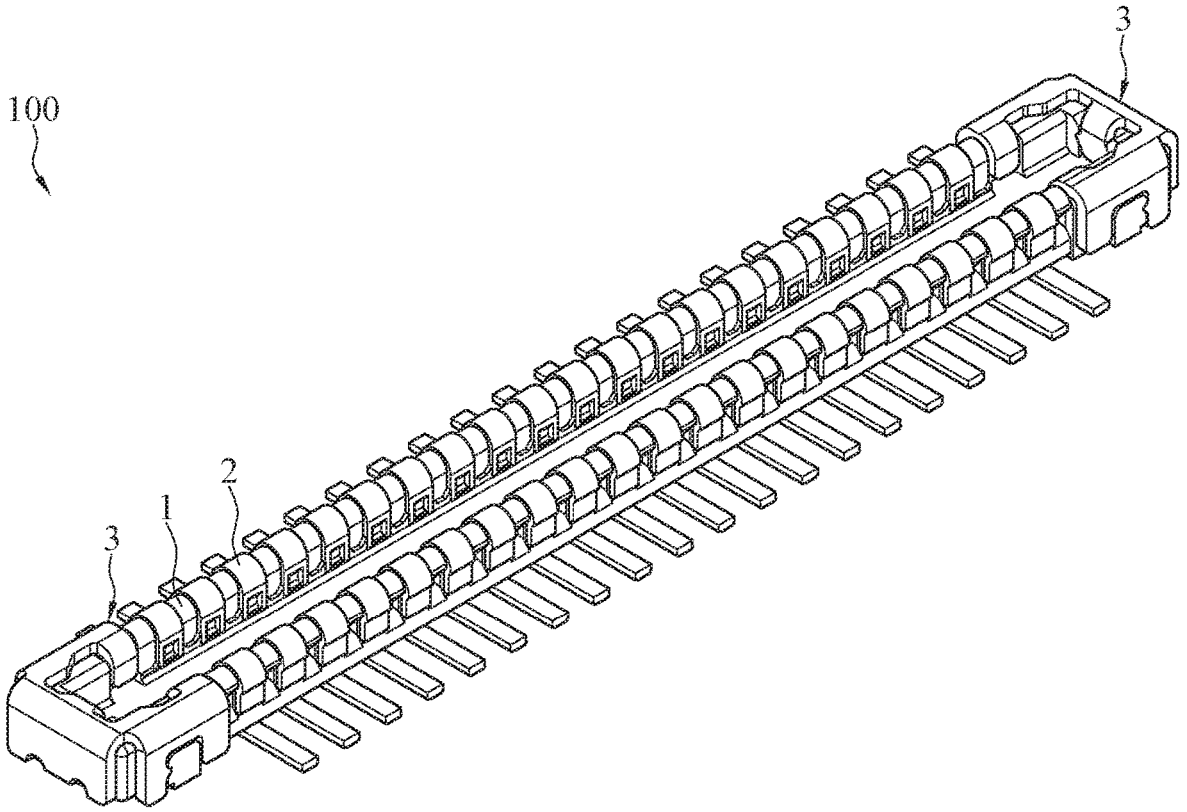
FIG. 9 illustrates a perspective view of a first connector according to a second embodiment of the instant disclosure.
Figure 10:
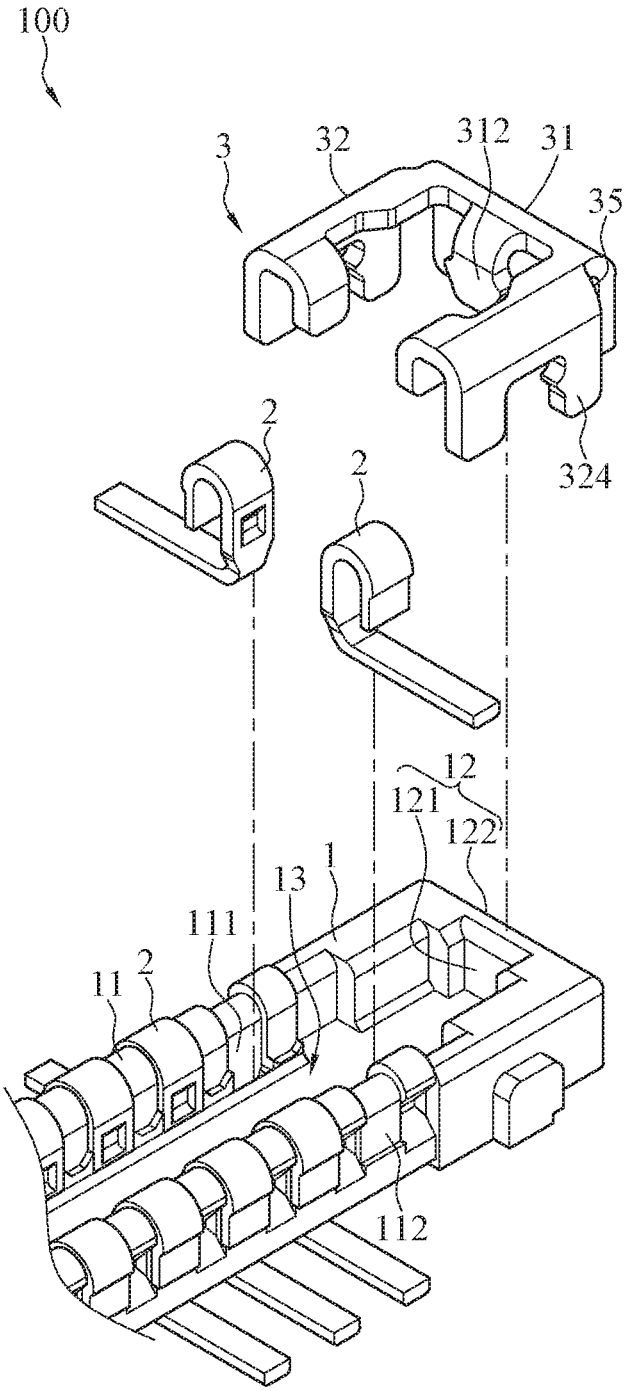
FIG. 10 illustrates an exploded view of the first connector of the second embodiment.
Figure 11:
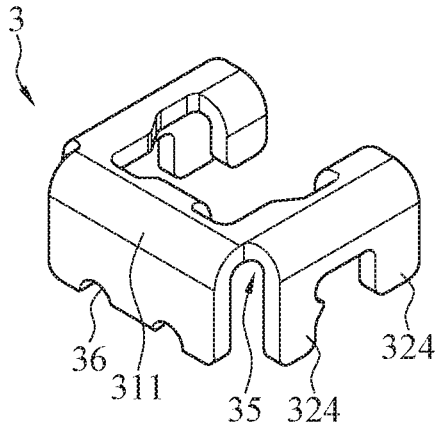
FIG. 11 illustrates a perspective view of a fastening member of the first connector of the second embodiment.

Please refer to FIGS. 9 to 11, an first connector 100 according to a second embodiment of the instant disclosure is illustrated. FIG. 9 illustrates a perspective view thereof, FIG. 10 illustrates an exploded view thereof, and FIG. 11 illustrates a perspective view of a fastening member thereof. A difference between the first connectors 100 of the second embodiment and the first embodiment is that, in the second embodiment, a notch 35 is formed between each of the first side plates 32 and the two ends of each of the first covering plates 31 of the first connector 100.

In this embodiment, more particularly, a plurality of legs 324 is on each of the first side plates 32 of the first connector 100.

Figure 12:
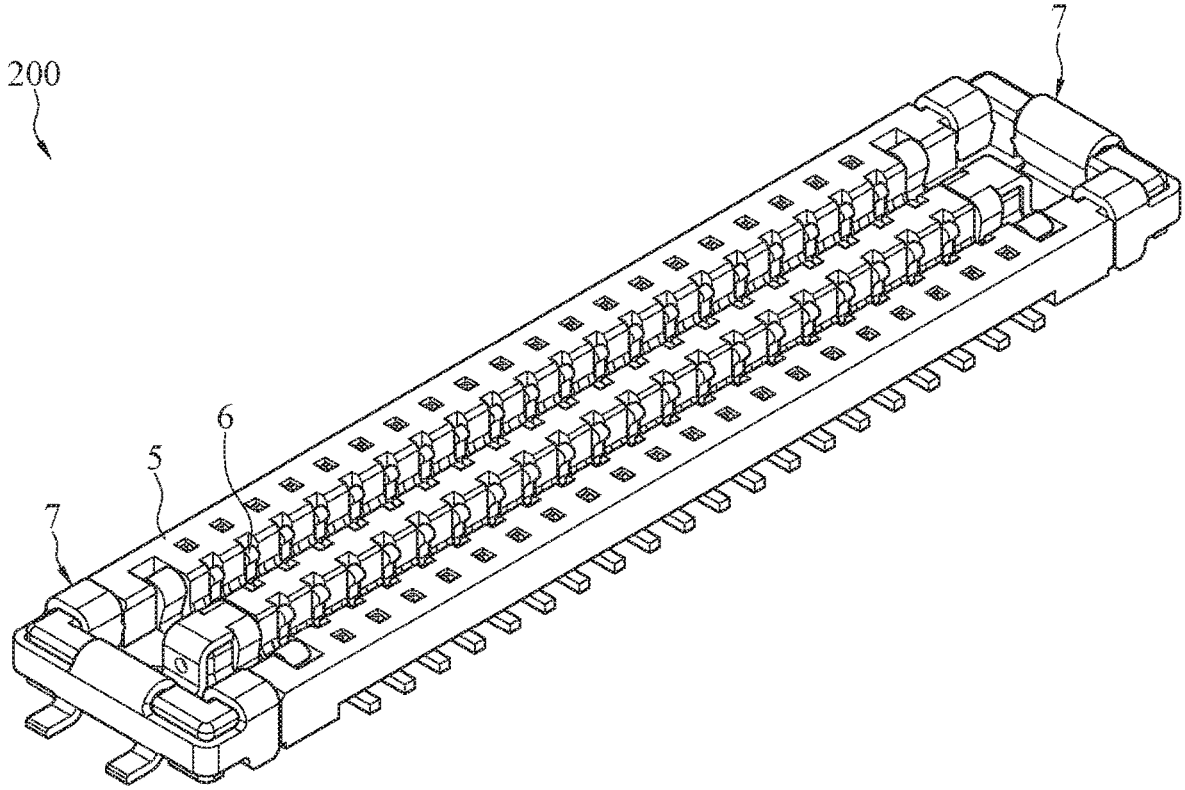
FIG. 12 illustrates a perspective view of a second connector of the second embodiment.
Figure 13:
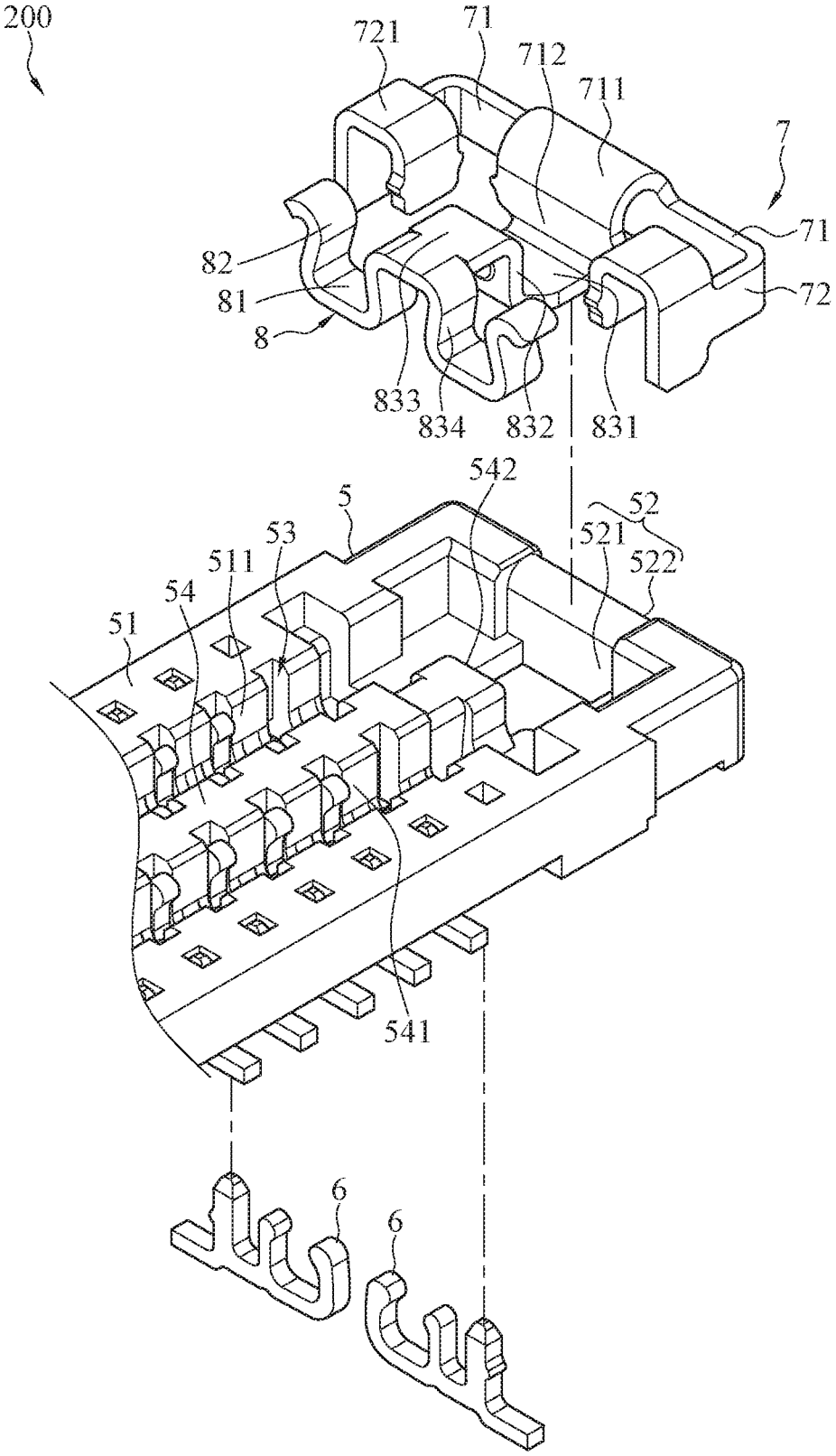
FIG. 13 illustrates an exploded view of the second connector of the second embodiment.
Figure 14:
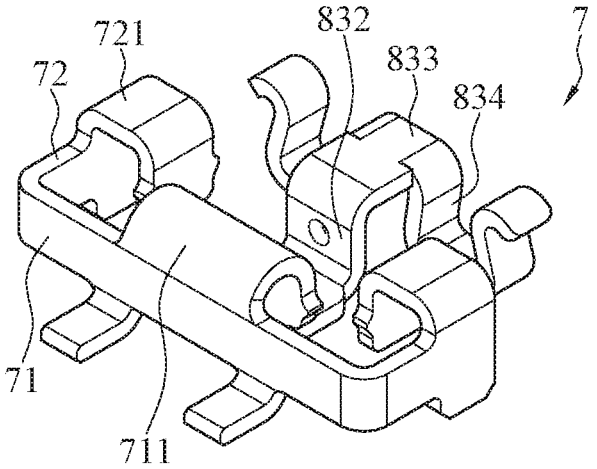
FIG. 14 illustrates a perspective view of a positioning member of the second connector of the second embodiment.

Please refer to FIGS. 12, 13, and 14, an second connector 200 of the second embodiment is illustrated. FIG. 12 illustrates a perspective view thereof, FIG. 13 illustrates an exploded view thereof, and FIG. 14 illustrates a perspective view of a positioning member thereof. A difference between the second connectors 200 in the second embodiment and the first embodiment is that, in the second embodiment, each of the contact arms 8 of the second connector 200 comprises a first extension portion 831. The first extension portion 831 bends outwardly from a bottom portion of the end contact sheet 712 of each of the second covering plates 71 toward the inner portion of the second connection space 53. The first extension portion 831 is a flat plate and in the bottom portion of the second connection space 53.

A difference between the second connectors 200 in the second embodiment and the first embodiment is that, in the second embodiment, each of the contact arms 8 of the second connector 200 comprises a second extension portion 832. The second extension portion 832 bends outwardly from an end portion of the first extension portion 831 toward an end portion 542 of the guiding column 54. The second extension portion 832 is perpendicular to the first extension portion 831, and the first extension portion 831 and the second extension portion 832 are together formed as an L-shaped structure.

A difference between the second connectors 200 in the second embodiment and the first embodiment is that, in the second embodiment, each of the contact arms 8 of the second connector 200 comprises a third extension portion 833. The third extension portion 833 bends outwardly from a top portion of the second extension portion 832 toward a top portion of the guiding column 54. The third extension portion 833 is parallel to the first extension portion 831. In this embodiment, the third extension portion 833 is located at the top portion of the second extension portion 832, and the first extension portion 831 is located at the bottom portion of the second extension portion 832.

A difference between the second connectors 200 in the second embodiment and the first embodiment is that, in the second embodiment, each of the contact arms 8 of the second connector 200 comprises two fourth extension portions 834. The two fourth extension portions 834 bend outwardly from two sides of the third extension portion 833 toward the side portion of the guiding column 54. The third extension portion 833 and the fourth extension portions 834 at the two sides of the third extension portion 833 are together formed as an upside-down U-shape structure.

A difference between the second connectors 200 in the second embodiment and the first embodiment is that, in the second embodiment, each of the contact arms 8 of the second connector 200 comprises two extension arms 81. Each of the extension arms 81 bends outwardly from an end portion of each of the fourth extension portions 834 toward the inner portion of the second connection space 53.

A difference between the second connectors 200 in the second embodiment and the first embodiment is that, in the second embodiment, each of the contact arms 8 of the second connector 200 comprises two elastic arms 82. Each of the elastic arms 82 bends outwardly from an end portion of each of the extension arms 81 toward the inner surface 511 of each of the second side walls 51. In the contact arm 8 of the second embodiment, elastic arm structures extend from the two sides of the third extension portion 833.

In this embodiment, the positioning member 7 is a large-area enclosing structure so as to stand impacts from outside and to increase the mating/unmating times for the connector.

In this embodiment, the second extension portion 832 covers the end portion 542 of the guiding column 54, the third extension portion 833 covers the top portion of the guiding column 54, and the fourth extension portions 834 cover the side portion of the guiding column 54. Hence, the guiding column 54 can be properly protected by the enclosing of the extension portions. Accordingly, during the mating/unmating procedure, if the first connector 100 is mated with the second connector 200 in a misalignment, the guiding column 54 can be protected by the enclosing structures, and is not damaged by the pressing from the first connector 100.

In this embodiment, more specifically, protruding spots protrude from an inner side of the second extension portion 832, and the protruding spots can be engaged with the recessed portions at the end portion 542 of the guiding column 54. Therefore, during the mating/unmating procedure, the contact arms 8 are not detached from the insulated base 5.

In this embodiment, more specifically, the elastic arm 82 of the contact arm 8 extends outwardly so as to increase the contact area, thereby suitable for large-current application. The outward extending structure of the elastic arm 82 enhances the robustness of the elastic arm 8 to provide a stable signals. Moreover, the end portion of the elastic arm 82 is located below the surface of the insulated base 5 (in the recessed portion at the inner surface 511 of the second side wall 51). Hence, during the mating/unmating procedure, the end portion of the elastic arm 82 can be protected to prevent from being bent reversely or pressed to cause elastic fatigue.

In this embodiment, more specifically, from a top view of the contact arm 8, the contact arm 8 is approximately of a W-shaped structure so as to increase spare contacts. The positioning member 7 and the contact arms 8 together provide six contacts, two contacts may be used as the current contacts, and rest four contacts are served as spare contacts. Hence, by increasing the contacts of the connector, the specification and the mating/unmating force of the connector can be adjusted for matching large-current transmission applications. The six contacts are respectively the end contact sheet 712, the second extension portion 832, the two fourth extension portions 834, and the two elastic arms 82, in which the two elastic arms 82 are used as the current contacts.

Figure 15:
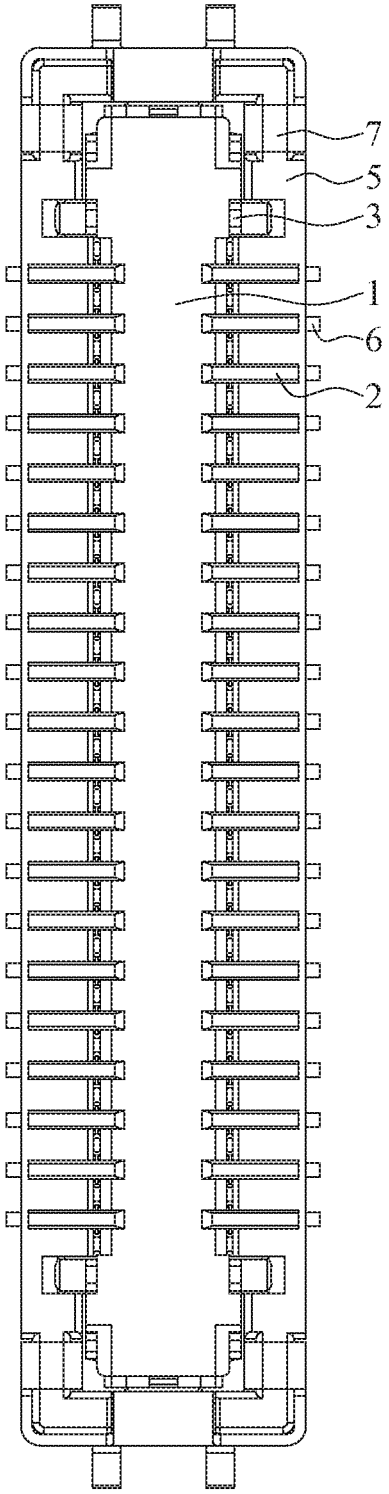
FIG. 15 illustrates a top view showing that the first connector is mated with the second connector of the second embodiment.
Figure 16:
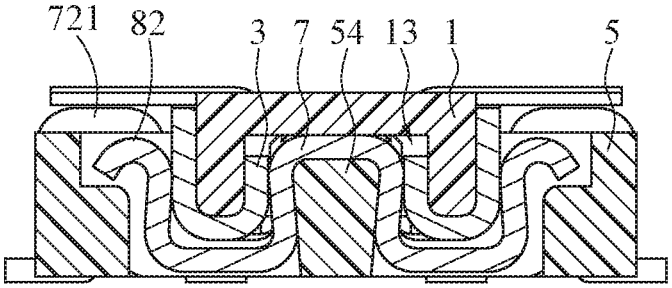
FIG. 16 illustrates a cross-sectional view showing that the first connector is mated with the second connector of the second embodiment.

In this embodiment, more specifically, the contact arm 8 of the positioning member 7 form a stair configuration. The first stair increase the enclosed area of the insulated base 5, so that the insulated base 5 can be protected effectively and prevented from being pressed. The second stair ensures the structural strength of the contact arm 8 so as to prevent the contact arm 8 from being deformed during assembling or during the mating/unmating procedures. The third stair protects the guiding column 54 and corresponds to the first connector 100, so that spaces in the second connector 200 can be reserved for mating with the first connector 100 (as shown in FIGS. 15 and 16).

In this embodiment, more specifically, the end top plate 711 of the second covering plate 71 and the side top plate 721 of the second side plate 72 are higher than the surface of the guiding column 54. Therefore, when the first connector 100 is mated with the second connector 200, the first connector 100 can be guided by the end top plates 711 and the side top plates 721 of the second connector 200.

According to one or some embodiments of the instant disclosure, the fastening member is an enclosing structure. The first covering plates and the first side plates respectively cover the pair of first side walls and the pair of first end walls of the insulated body, so that the first covering plates, the end contact sheets, the first side plates, and the side contact sheets provide multi-point contacts. Accordingly, during the inserting/detaching procedure, if the first connector is mated with the second connector in a misalignment, the guiding column can be protected by the enclosing structures, and is not damaged by the pressing from the first connector.

According to one or some embodiments of the instant disclosure, the positioning member is a large-area enclosing structure. The second covering plates and the second side plates respectively cover the pair of second side walls and the pair of second end walls of the insulated base, so that the end contact sheets, the side contact sheets, and the contact arms provide multi-point contacts.

According to one or some embodiments of the instant disclosure, the contact areas of the concave portions of the first covering plates of the second connector increase. Hence, when the first connector is welded on the circuit board, the proper fixation for solder contact as well as multi-point welding design can be provided.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A first connector, comprising:

an insulated body comprising a pair of first side walls and a pair of first end walls, wherein the pair of first side walls and the pair of first end walls are enclosed to form a first connection space;

a plurality of first terminals held in the pair of first side walls; and a plurality of fastening members, wherein each of the fastening members comprises:

a first covering plate, wherein each of the first covering plates is held in an outer surface of each of the first end walls, an end top plate extends from each of the first covering plates and covers a top portion of each of the first end walls, an end contact sheet is in the first connection space and bends inwardly from the end top plate, and the end contact sheet covers an inner surface of each of the first end walls; and a plurality of first side plates, wherein each of the first side plates is held in an outer surface of each of the first side walls, a side top plate extends from each of the first side plates and covers a top portion of each of the first side walls, a side contact sheet is in the first connection space and bends inwardly from the side top plate, and the side contact sheet covers an inner surface of each of the first side walls.

2. The first connector according to claim 1, wherein each of the fastening members comprises a plurality of turning sheets extending from two ends of each of the first covering plates toward each of the first side plates.

3. The first connector according to claim 1, wherein a notch is formed between each of the first side plates and the two ends of each of the first covering plates.

4. The first connector according to claim 2, wherein a plurality of concave portions is recessed from a bottom end of each of the first covering plates.

5. The first connector according to claim 1, wherein one or more legs are on each of the first side plates.

6. A second connector, comprising:

an insulated base comprising a pair of second side walls and a pair of second end walls, wherein the pair of second side walls and the pair of second end walls are enclosed to form a second connection space, and the insulated base comprises a guiding column in an inner portion of the second connection space;

a plurality of second terminals respectively held in the pair of second side walls and two sides of the guiding column; and a plurality of positioning members, wherein each of the positioning members comprises:

a second covering plate, wherein each of the second covering plates is held in an outer surface of each of the second end walls, an end top plate extends from each of the second covering plates and covers a top portion of each of the second end walls, an end contact sheet is in the second connection space and bends inwardly from the end top plate, and the end contact sheet covers an inner surface of each of the second end walls;

a plurality of second side plates, wherein each of the second side plates is held in an outer surface of each of the second side walls, a side top plate extends from each of the second side plates and covers a top portion of each of the second side walls, a side contact sheet is in the second connection space and bends inwardly from the side top plate, and the side contact sheet covers an inner surface of each of the second side walls; and a plurality of contact arms respectively held in the inner portion of the second connection space and the two sides of the guiding column, wherein each of the contact arms comprises an extension arm and an elastic arm, the extension arm extends outwardly from a bottom portion of the side contact sheet of each of the second side plates toward the inner portion of the second connection space, and the elastic arm bends outwardly from an end portion of the extension arm toward a side portion of the guiding column.

7. The second connector according to claim 6, wherein a protruding portion protrudes from the side contact sheet of each of the second side plates.

8. The second connector according to claim 6, wherein each of the contact arms comprises a first extension portion, a second extension portion, a third extension portion, and two fourth extension portions, the first extension portion bends outwardly from a bottom portion of the end contact sheet of each of the second covering plates toward the inner portion of the second connection space, the second extension portion bends outwardly from an end portion of the first extension portion toward an end portion of the guiding column, the third extension portion bends outwardly from a top portion of the second extension portion toward a top portion of the guiding column, and the two fourth extension portions bend outwardly from two sides of the third extension portion toward a side portion of the guiding column.

9. The second connector according to claim 8, wherein each of the contact arms comprises two extension arms and two elastic arms, each of the extension arms bends outwardly from an end portion of each of the fourth extension portions toward the inner portion of the second connection space, and each of the elastic arms bends outwardly from an end portion of each of the extension arms toward the inner surface of each of the second side walls.

10. A second connector, comprising:

an insulated base comprising a pair of second side walls and a pair of second end walls, wherein the pair of second side walls and the pair of second end walls are enclosed to form a second connection space, and the insulated base comprises a guiding column in an inner portion of the second connection space;

a plurality of second terminals respectively held in the pair of second side walls and two sides of the guiding column; and a plurality of positioning members, wherein each of the positioning members comprises:

a second covering plate, wherein each of the second covering plates is held in an outer surface of each of the second end walls, an end top plate extends from each of the second covering plates and covers a top portion of each of the second end walls, an end contact sheet is in the second connection space and bends inwardly from the end top plate, and the end contact sheet covers an inner surface of each of the second end walls;

a plurality of second side plates, wherein each of the second side plates is held in an outer surface of each of the second side walls, a side top plate extends from each of the second side plates and covers a top portion of each of the second side walls, a side contact sheet is in the second connection space and bends inwardly from the side top plate, and the side contact sheet covers an inner surface of each of the second side walls; and a plurality of contact arms respectively held in the inner portion of the second connection space and the two sides of the guiding column, wherein each of the contact arms comprises a first extension portion, a second extension portion, a third extension portion, and two fourth extension portions, the first extension portion bends outwardly from a bottom portion of the end contact sheet of each of the second covering plates toward the inner portion of the second connection space, the second extension portion bends outwardly from an end portion of the first extension portion toward an end portion of the guiding column, the third extension portion bends outwardly from a top portion of the second extension portion toward a top portion of the guiding column, and the two fourth extension portions bend outwardly from two sides of the third extension portion toward a side portion of the guiding column.

11. The second connector according to claim 10, wherein each of the contact arms comprises two extension arms and two elastic arms, each of the extension arms bends outwardly from an end portion of each of the fourth extension portions toward the inner portion of the second connection space, and each of the elastic arms bends outwardly from an end portion of each of the extension arms toward the inner surface of each of the second side walls.

* * * * *